US010172482B2

(12) United States Patent
Pritchard

(10) Patent No.: US 10,172,482 B2
(45) Date of Patent: Jan. 8, 2019

(54) SHELF MANAGEMENT DEVICE

(71) Applicant: THE HEARTBEAT MANUFACTURING CO (REDDITCH) LIMITED, Lakeside Redditch, Worcestershire (GB)

(72) Inventor: James Pritchard, Lakeside Redditch (GB)

(73) Assignee: THE HEARTBEAT MANUFACTURING CO (REDDITCH) LIMITED, Lakeside Redditch, Worcestershire (GB)

( * ) Notice: Subject to any disclaimer, the term of this patent is extended or adjusted under 35 U.S.C. 154(b) by 0 days.

(21) Appl. No.: 15/546,831

(22) PCT Filed: Jan. 27, 2016

(86) PCT No.: PCT/GB2016/050168
§ 371 (c)(1),
(2) Date: Jul. 27, 2017

(87) PCT Pub. No.: WO2016/120611
PCT Pub. Date: Aug. 4, 2016

(65) Prior Publication Data

US 2018/0000262 A1 Jan. 4, 2018

(30) Foreign Application Priority Data

Jan. 28, 2015 (CN) ..... 2015 2 0059328 U
Jan. 28, 2015 (CN) ..... 2015 2 0059373 U
Mar. 12, 2015 (GB) ..... 1504218.7

(51) Int. Cl.
*A47F 1/12* (2006.01)

(52) U.S. Cl.
CPC ..... *A47F 1/126* (2013.01)

(58) Field of Classification Search
CPC ..... A47F 1/126; A47F 5/005; A47F 7/0007; A47F 7/28; A47F 1/00; A47F 1/04;
(Continued)

(56) References Cited

U.S. PATENT DOCUMENTS 2,446,788 A * 8/1948 Rifkin ..... F25D 11/04 221/279
2,522,896 A * 9/1950 Rifkin ..... A47F 1/126 221/207

(Continued)

FOREIGN PATENT DOCUMENTS

CA 1327032 2/1994
CN 2576107 10/2003

(Continued)

OTHER PUBLICATIONS

International Search Report for PCT/GB2016/050168, Completed by the European Patent Office dated Apr. 29, 2016, 7 Pages.

(Continued)

*Primary Examiner* — Jennifer E. Novosad
(74) *Attorney, Agent, or Firm* — Brooks Kushman P.C.

(57) ABSTRACT

A shelf management device including a guide member having a front end and a rear end, and a pusher device guided for movement by the guide member. Wherein the pusher device includes a rotatable spool upon which is wound a flexible drive member, an end part of the drive member being secured to the guide member at or adjacent the front end thereof. A spring is provided to urge the spool for rotation to take up the drive member and thereby apply a load to the pusher device urging the pusher device towards the front end of the guide member.

7 Claims, 5 Drawing Sheets

(58) Field of Classification Search
CPC ... A47F 1/125; A47F 3/02; A47F 5/10; A47B 57/58; A47B 65/10; A47B 73/00
USPC ..... 211/59.3, 184, 74; 312/61, 71; 221/52–54, 56, 198, 226, 227, 279
See application file for complete search history.

(56) References Cited

U.S. PATENT DOCUMENTS 2,893,596 A * 7/1959 Gabrielsen ..... G07F 11/42 221/129
3,166,195 A * 1/1965 Taber ..... A47F 1/126 206/817
4,269,326 A * 5/1981 Delbrouck ..... A47F 1/126 221/227
4,300,693 A * 11/1981 Spanner ..... A47F 1/126 211/59.3
4,303,162 A * 12/1981 Suttles ..... A47F 1/126 211/59.3
4,316,554 A * 2/1982 Lloyd ..... B64D 1/02 116/209
4,351,439 A 9/1982 Taylor
4,378,872 A * 4/1983 Brown ..... B65G 1/06 198/570
4,729,481 A * 3/1988 Hawkinson ..... A47F 1/126 211/59.3
4,775,058 A * 10/1988 Yatsko ..... A47F 5/005 108/61
4,830,201 A * 5/1989 Breslow ..... A47F 1/126 211/184
4,896,779 A * 1/1990 Jureckson ..... A47F 5/005 211/184
5,110,192 A * 5/1992 Lauterbach ..... A47F 1/126 211/59.3
5,161,702 A * 11/1992 Skalski ..... A47F 1/126 211/43
5,460,294 A * 10/1995 Williams ..... G07F 11/42 221/12
6,129,218 A * 10/2000 Henry ..... A47F 1/126 211/59.3
6,142,317 A * 11/2000 Merl ..... A47F 1/125 211/184
6,409,028 B2 * 6/2002 Nickerson ..... A47F 1/126 108/61
6,464,089 B1 * 10/2002 Rankin, VI ..... A47F 1/126 211/59.3
6,523,703 B1 * 2/2003 Robertson ..... A47F 1/126 211/51
6,572,277 B1 6/2003 Ritter et al.
6,655,536 B2 * 12/2003 Jo ..... A47F 1/126 211/184
6,820,754 B2 * 11/2004 Ondrasik ..... A47F 1/126 211/59.3
7,316,328 B2 * 1/2008 Yuyama ..... G07F 11/165 221/227
7,404,494 B2 * 7/2008 Hardy ..... A47F 1/125 211/1.57
7,424,957 B1 * 9/2008 Luberto ..... A47F 1/126 211/59.3
7,641,072 B1 * 1/2010 Vlastakis ..... A47F 1/126 221/123
7,845,101 B2 * 12/2010 Padiak ..... G09F 11/02 116/79
8,047,385 B2 * 11/2011 Hardy ..... A47F 1/12 211/59.3
8,056,740 B2 * 11/2011 Weshler ..... A47F 7/024 211/119.003
8,146,753 B2 * 4/2012 Yuyama ..... A61G 12/001 211/59.3
8,172,094 B2 * 5/2012 Meyer ..... A47F 5/005 211/134
8,251,232 B2 * 8/2012 Nakaya ..... A47F 1/126 211/59.2
8,353,425 B2 * 1/2013 Lockwood ..... A47F 1/126 221/227
8,627,965 B2 * 1/2014 Hardy ..... A47F 1/126 211/184
8,646,650 B2 * 2/2014 Lockwood ..... A47F 1/126 211/1.51
9,451,836 B2 * 9/2016 Szpak ..... A47F 1/04
9,468,309 B2 * 10/2016 Grubbs ..... A47F 5/005
9,750,354 B2 * 9/2017 Hardy ..... A47F 1/126
2002/0170866 A1 * 11/2002 Johnson ..... A47F 1/126 211/59.3
2006/0163272 A1 * 7/2006 Gamble ..... A47F 1/126 221/227
2007/0108142 A1 * 5/2007 Medcalf ..... A47F 1/126 211/59.3
2009/0084812 A1 4/2009 Kirschner
2009/0261048 A1 10/2009 Roeske
2010/0059469 A1 * 3/2010 Mason ..... A47F 1/126 211/162
2011/0127287 A1 6/2011 Nakaya et al.
2011/0139736 A1 * 6/2011 Hardy ..... A47F 1/126 211/59.3
2011/0174750 A1 * 7/2011 Poulokefalos ..... A47F 1/126 211/59.3
2014/0117818 A1 * 5/2014 Dipaolo ..... A47F 3/002 312/139
2014/0151313 A1 * 6/2014 Breslow ..... A47F 1/04 211/59.3
2014/0353265 A1 * 12/2014 Rankin, VI ..... A47F 1/126 211/59.3
2015/0129521 A1 * 5/2015 Sun ..... A47F 1/125 211/59.3
2015/0157142 A1 * 6/2015 Turner ..... A47F 1/125 211/59.3
2017/0164762 A1 * 6/2017 Bryson ..... A47F 1/126
2018/0000262 A1 * 1/2018 Pritchard ..... A47F 1/126

FOREIGN PATENT DOCUMENTS

| | | |
|---|---|---|
| CN | 203897858 | 10/2014 |
| DE | 3211859 | 10/1983 |
| DE | 202013102529 | 6/2013 |
| EP | 2591703 | 5/2013 |
| EP | 2767192 | 8/2014 |
| GB | 2392667 | 3/2004 |
| JP | 2006239137 | 9/2006 |
| WO | 2005065058 | 7/2005 |
| WO | 2014198839 | 12/2014 |
| WO | 2015003682 | 1/2015 |

OTHER PUBLICATIONS

Great Britian Search Report for Application No. GB 1601483.9, dated Jun. 30, 2016, 1 Page.
Great Britian Search Report for Application No. GB 1504218.7, dated Jul. 10, 2015, 1 Page.
Great Britian Search Report for Application No. GB 1504218.7 dated Nov. 24, 2015, 2 Pages.

* cited by examiner

SHELF MANAGEMENT DEVICE

CROSS-REFERENCE TO RELATED APPLICATION

This application is the U.S. national phase of PCT Application No. PCT/GB2016/050168 filed on Jan. 27, 2016, which claims priority to CN Patent Application No. 201520059373.6 filed on Jan. 28, 2015, and CN Patent Application No. 201520059328.0 filed on Jan. 28, 2015, and GB Patent Application No. 1504218.7 filed on Mar. 12, 2015, the disclosures of which are incorporated in their entirety by reference herein.

This invention relates to a shelf management device, for example suitable for use on a shelf of a supermarket or the like to ensure that products are located at the front of the shelf in a neat and tidy fashion.

Supermarkets and other retail establishments prefer for products located upon the shelves thereof to be positioned towards the front of the shelves. This has several benefits. Firstly, the products are clearly visible to and readily accessible by customers. As a result, product sales may be enhanced. Secondly, the appearance of the products upon the shelves is enhanced. These benefits are particularly advantageous where the shelves used in the supermarket or the like are relatively deep. Market research has shown that sales are enhanced where products are located at the front of the shelves.

A number of devices are available to assist in achieving this effect by moving products upon the shelves towards the front of the shelves each time a product is removed therefrom. Typically, such devices take the form of a spring biased pusher operable to push products towards the front of the shelf, and a stop arrangement operable to prevent products from being pushed over the front of the shelf, stopping and supporting the products at or adjacent the front of the shelf. In one known arrangement, a coiled spring is used to drive the pusher for movement, an end of the spring being secured to a guide adjacent the front of the shelf, the other end of the spring being attached to the pusher. Whilst such an arrangement operates satisfactorily, the exposed part of the spring is thought to look unsightly. It may also have sharp edges and so present an injury risk to individuals removing products from the shelf or restocking the shelf. The stop arrangements used are typically rigid, making restocking of the shelf relatively difficult as products must be lifted over the stop arrangement. As the shelves are often vertically spaced from one another by a relatively small distance, leaving minimal clearance above the products on display, such lifting usually also requires the products to be tilted in order to be lifted over the stop arrangement. This is inconvenient, and limits the number of stock items that can be added to the shelf at the same time. As a result, the restocking operation is impeded.

Additionally, the devices are typically secured to a mounting rail located to the front edge of the shelf, and to a mounting rail located to the rear of the shelf. As a result, installation and adjustment of the positions of the devices is difficult and timely to accomplish. Where such devices are provided on only some of the shelves, the presence of the devices may detract from the uniformity of the look of the shelves, making the shelf display less appealing and potentially resulting in reduced sales. Also, the devices tend to form a dust trap and their presence on the shelves results in cleaning of the shelves being hampered.

It is an object of the invention to provide a shelf management device in which at least some of the disadvantages associated with known shelf management devices are overcome or are of reduced effect.

According to one aspect of the invention there is provided a shelf management device comprising a guide member having a front end and a rear end, attachment formations provided at or adjacent the rear end for attachment to a mounting rail, and magnetic securing means provided at or adjacent the front end.

The mounting rail is conveniently provided with a series of teeth cooperable with corresponding formations provided on the attachment formations to resist movement of the guide member along the length of the mounting rail.

Preferably, at or adjacent the front end, the guide member is further provided with friction pads, for example of a suitable gel material.

In such an arrangement, once secured to the mounting rail, and held to the shelf by the magnetic securing means, movement of the rear end of the guide member is resisted. Lifting of the front end of the mounting rail is resisted by magnetic attraction between the magnetic securing means and the material of the shelf upon which the device is mounted, and the friction pads resist lateral movement of the device. Accordingly, once fitted to a shelf, movement of the guide member is resisted. The guide member is attached to the mounting rail to the rear of the shelf, and so the visible impact of the presence of the device is reduced. When it is desired to move the guide member, lifting of the front end thereof results in sufficient disengagement of the rear end from the rail that lateral movement of the guide member lengthwise of the rail is permitted.

According to a second aspect of the invention there is provided a shelf management device comprising a guide member having a front end and a rear end, stop means being located at or adjacent the front end, wherein the stop means comprises a stop member pivotally mounted to the guide member about a pivot axis and moveable between a retaining position in which it extends substantially perpendicularly to the guide member and a stocking position in which it extends substantially parallel to the guide member, lying alongside the guide member, and bias means urging the stop member towards the retaining position.

In such an arrangement, in use, products located upon the shelf upon which the device is installed can be urged into engagement with the stop means, the stop member serving to restrict movement of the products and so retain the products upon the shelf. If additional products are to be added to the shelf, this can be achieved by engaging the products with the outer surface of the stop member and applying a force to cause the stop member to pivot towards its stocking position whereon the products can be pushed past the stop member. After the products have been introduced in this manner, the biasing of the stop member results in it returning to the retaining position, thereby retaining the products in position upon the shelf. Lifting of the products over the stop member, or tilting of the products, is unnecessary. As a result, restocking of the shelf is simplified and may be accomplished more rapidly.

According to a further aspect of the invention there is provided a shelf management device comprising a guide member having a front end and a rear end, and a pusher device guided for movement by the guide member, wherein the pusher device comprises a rotatable spool upon which is wound a flexible drive member, an end part of the drive member being secured to the guide member at or adjacent the front end thereof, spring means being provided to urge the spool for rotation to take up the drive member and thereby apply a load to the pusher device urging the pusher device towards the front end of the guide member.

The drive member conveniently takes the form of a wire or cable. However, this need not be the case and it may take a range of other forms.

A damping arrangement may be provided to damp the rotation of the spool and thereby damp the movement of the pusher device arising from the rotation of the spool. The damping arrangement may comprise, for example, a brake member biased against a surface of the spool. Preferably, the load with which the brake member is biased against the surface of the spool is controllable, to allow control over the rate of movement of the pusher device.

It will be appreciated that such an arrangement is advantageous in that there is no need for part of a coiled spring to be exposed. As a result, fewer exposed sharp edges may be present. Furthermore, by controlling the rate at which the pusher member is moved, the risk of injury or damage to products moved by the device can be reduced.

It will be appreciated that any two or more of the various aspects of the invention may be used in combination with one another, if desired.

The invention will further be described, by way of example, with reference to the accompanying drawings, in which.

Figure 2:
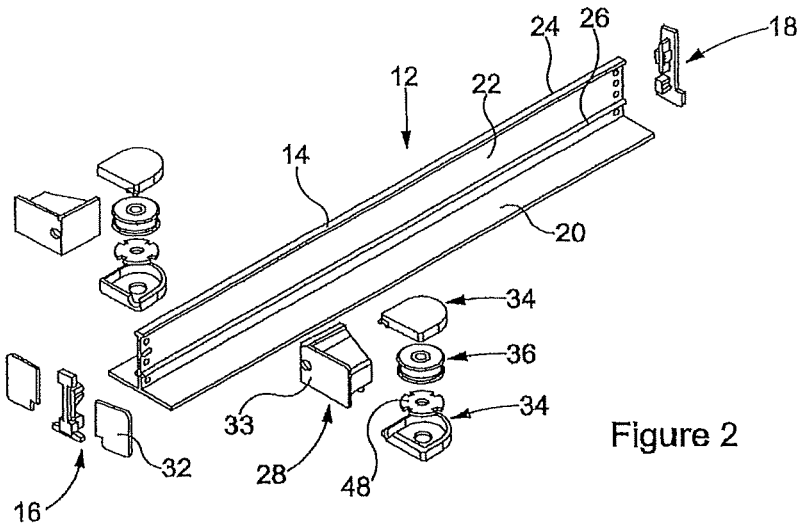
FIG. 2 is an exploded view illustrating a device similar to that of FIG. 1.
Figure 6:
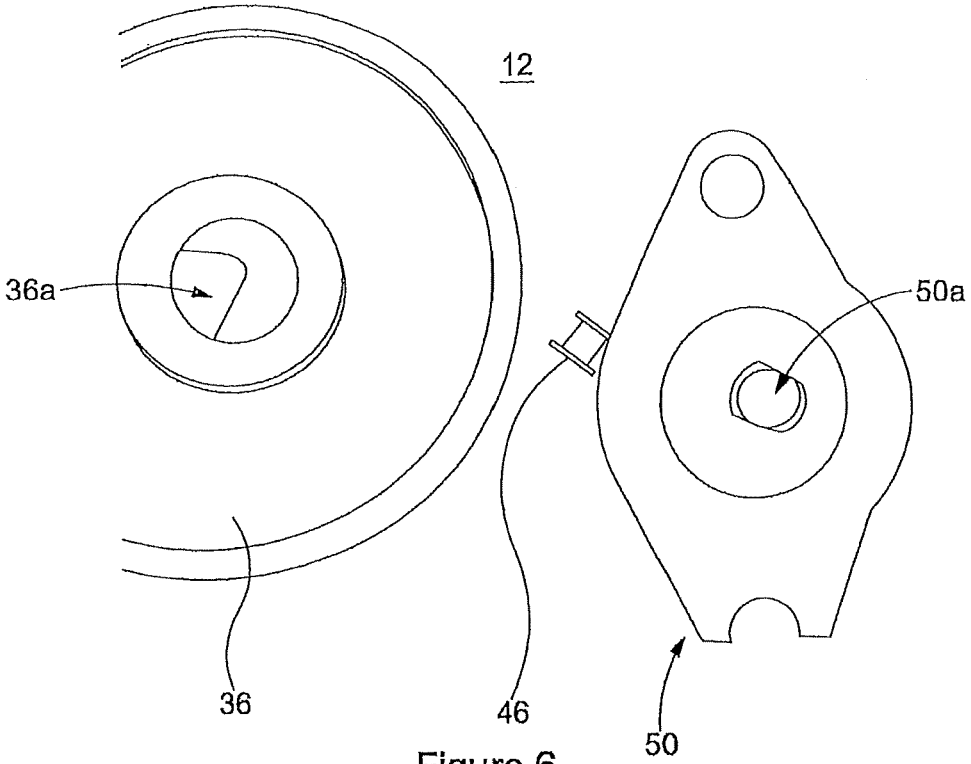
Figure 2A:
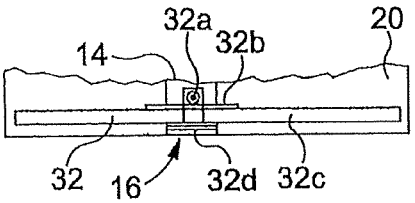
Figure 2B:
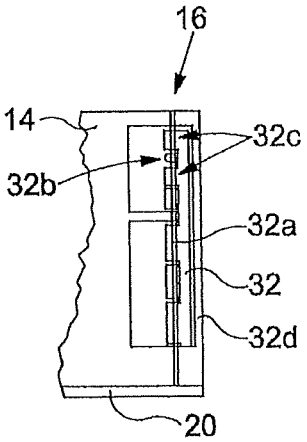
Figure 3:
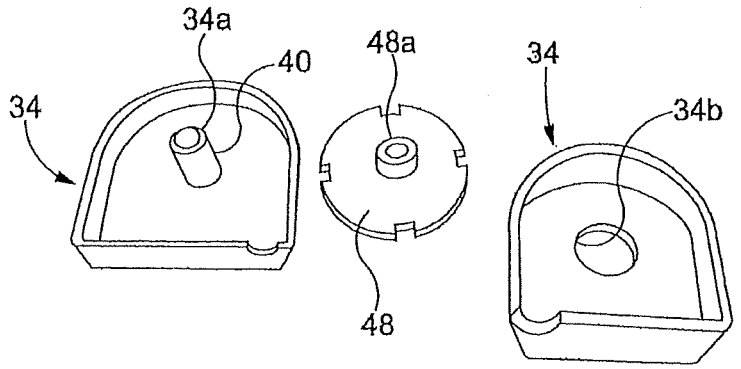
Figure 4:
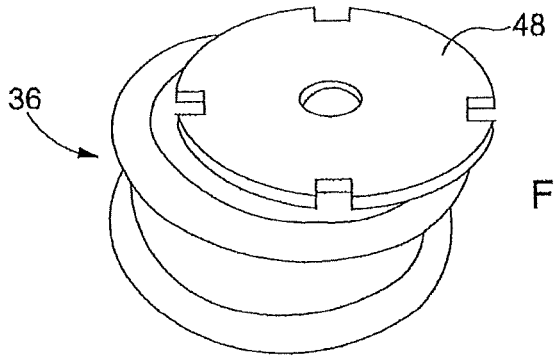
Figure 5:
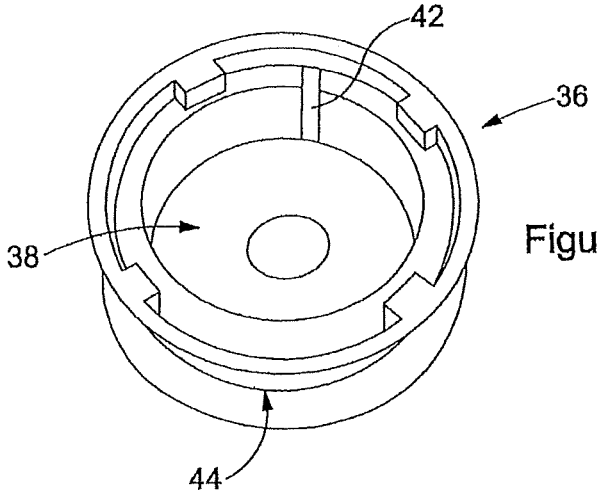

FIGS. 2*a* and 2*b* are views illustrating a modification to the arrangement of FIG. 2;

FIGS. 3 to 8 are images illustrating various parts of the shelf management device; and FIGS. 9 to 13 are views illustrating alternative devices in accordance with embodiments of the invention.

Figure 1:
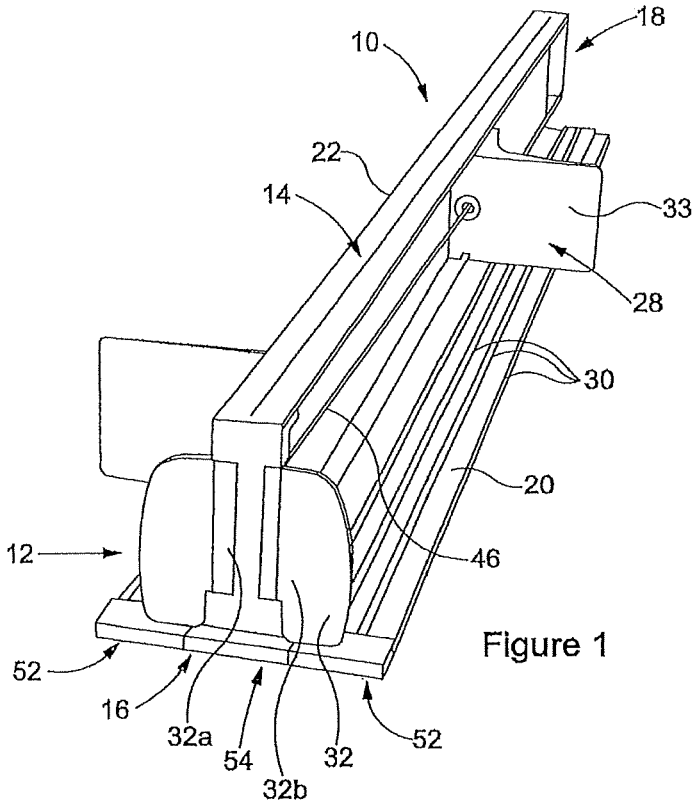
FIG. 1 is an illustration showing part of a shelf management device in accordance with an aspect of the invention.

Referring firstly to FIGS. 1 and 2, a shelf management device 10 is illustrated, the device 10 comprising a guide member 12 including a main part 14, conveniently of elongate extruded plastics material form, to the front and rear ends of which are secured front and rear end fittings 16, 18, preferably of moulded plastics material form. The shelf management device 10 is intended, in use, to be mounted upon a shelf in, for example, a supermarket or the like, with the front end located at or adjacent the front edge of the shelf, the rear end being located to the rear of the shelf, the main part 14 extending in a direction substantially perpendicular to the longitudinal extent of the shelf.

The main part 14 includes a base 20 arranged to sit upon the upper surface of the shelf, and an upstanding guide rail 22 formed integrally with the base 20, the guide rail 22 including upper and lower guides 24, 26 adapted to cooperate with a pusher device 28 to guide the pusher device 28 for movement along the length of the guide member 12.

As best shown in FIG. 1, the upper surface of the base 20 is provided with a series of axially extending, upstanding ribs 30. In use, a product to be located upon the shelf is supported upon the ribs 30, and it is thought that the slight spacing of the lower surface of the product from the upper surface of the shelf and base 20 resulting from the presence of the ribs 30 aids sliding movement of the product.

The rear end fitting 18 is shaped so as to limit movement of the pusher device 28 away from the front end of the device 10, cooperating with the pusher device 28 when the limit of movement in that direction is reached. The front end fitting 16 also serves to limit the movement of the pusher device 28, but also serves some other functions. Specifically, the front end fitting 16 carries a generally vertically extending pivot pin 32*a* which secures a stop member 32 to the front end fitting 16, guiding the stop member 32 for pivotal movement between a retaining position (as shown in FIG. 1) in which the stop member 32 extends generally perpendicularly to the axial length of the guide member 12, and a stocking position in which it extends generally parallel to the length of the guide member 12, lying alongside the guide member 12. Movement of the stop member 32 beyond these positions is not permitted, cooperation between the stop member 32 and the front end fitting 16 preventing movement of the stop member 32 beyond the retaining position. A spring 32*b* encircles a part of the pivot pin 32*a*, the ends of the spring 32*b* cooperating with the front end fitting 16 and the stop member 32 to apply a biasing load to the stop member 32 urging the stop member 32 towards the retaining position.

FIGS. 2*a* and 2*b* illustrate an alternative design of stop member 32 to that shown in FIG. 2. In the arrangement of FIGS. 2*a* and 2*b*, a pair of stop members 32 are provided, mounted upon a single pivot pin 32*a*. In order to achieve this, the stop members 32 are provided with knuckles 32*c* defining openings through which the pin 32*a* extends, the knuckles 32*c* of one of the stop members 32 being out of alignment with those of the other of the stop members 32. A single spring 32*b* may be used to bias both stop members 32 towards their respective retaining positions. Mounting both stop members upon a single pin allows a reduction in the spacing between the stop members, and so a reduction in the distance by which stock is laterally spaced apart. The presence of the knuckles ensures that when in the restocking position, the stop members 32 can lie alongside the guide member, not significantly impeding the introduction of stock adjacent the guide member. A limiter 32*d* forming part of the front end fitting 16 limits opening movement of the stop members 32 such that, at rest in the retaining position, parts of the front faces thereof engage the limiter 32*d* and are held substantially perpendicular to the length of the guide member 12. The limiter 32*d* is spaced from the front end of the guide member 12, parts of the stop members 32, including the knuckles, being located therebetween as shown. It will be appreciated that by arranging for the stop members to extend substantially perpendicularly to the length of the guide member 12, at rest, available shelf space for supporting stock is not restricted or limited significantly by the presence of the shelf management system, and the visual appeal of the stocked shelf is not impaired. Although sharing a common pin 32*a*, it will be appreciated that the stop members 32 are movable independently of one another.

The pusher device 28 mentioned hereinbefore comprises a pusher member 33 shaped to include channels receiving parts of the guides 24, 26 to guide the pusher device 28 for movement along the device 10. The pusher device 28 further comprises a spring housing 34 (most clearly shown in FIG. 3) mounted to the pusher member 33, the spring housing 34 containing a spool 36 (see FIGS. 3 to 5) mounted for rotation between formations 34*a*, 34*b* provided on the upper and lower parts of the spring housing 34. The spool 36 defines in inner spring chamber 38 in which, in use, a coiled spring 38*a* (see FIG. 6) is located, one end of the coiled spring 38*a* being located within a slot 40 provided in the formation 34*a*, the other end of the spring being located in a slot 42 formed in the spool 36 such that the spring serves to apply a biasing rotary load to the spool 36. The outer surface of the spool 36 defines an annular cable guide recess 44. A drive cable 46 or other flexible drive member is secured, at one end, to the spool 36, the cable 46 extending through openings formed in the spring housing 34 and pusher member 33, the other end of the cable 46 being secured to the front end fitting 16.

The spring chamber 38 is closed by a lid 48 fitted to the spool 36. The lid 36 defines an opening 48*a* with which a shaft of a damper member 50*a* (see FIG. 6) projecting from a damper housing 50 secured to the pusher device 28 cooperates. In one arrangement the damper housing 50 contains a spring biased brake arrangement that bears against or applies a braking load to the damper member 50*a*, thereby applying a braking or damping load to the spool 36 reducing the speed of rotation thereof, and thereby reducing the speed of movement of the pusher device 28 along the guide member 12 under the action of the spring.

Alternatively, the damper member 50*a* may be a viscous fluid or the like based rotary damper member. Conveniently, the damper member 50*a* supports the spool 36 for rotation, defining the axis of rotation thereof. The damper member 50*a* may be operable to damp rotary movement of the spool 36 in one rotary direction, allowing substantially unrestricted rotary movement thereof in the opposite direction. As a result, movement of the pusher in pushing stock towards the front edge of the shelf may be restricted, in use, but reverse movement of the pusher during restocking may be substantially unimpeded by the presence of the damper member 50*a*.

Figure 7:
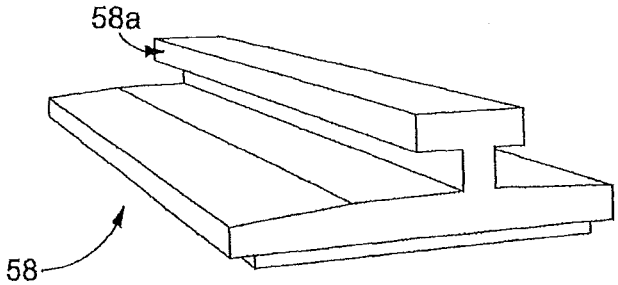
Figure 8:
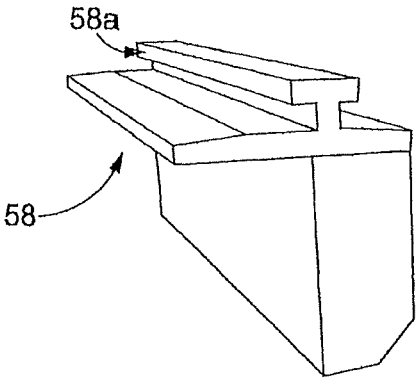
Figure 9:
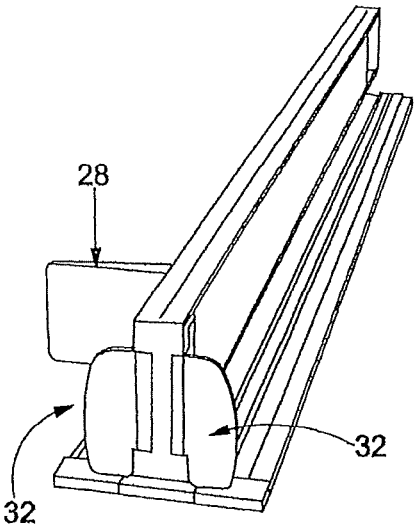
Figure 10:
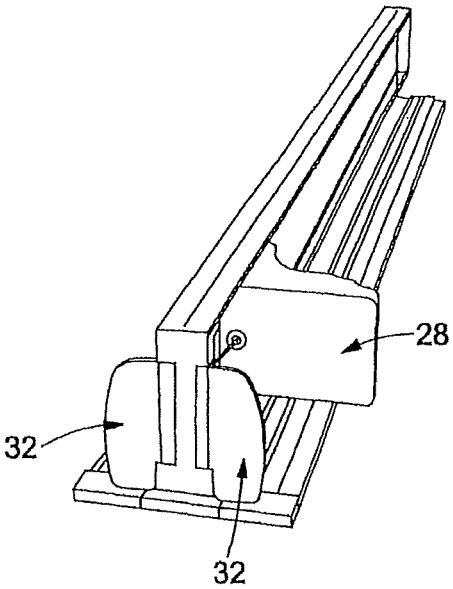
Figure 11:
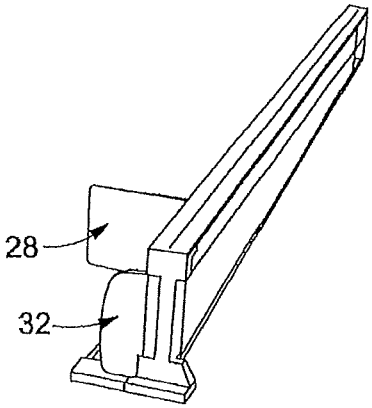
Figure 12:
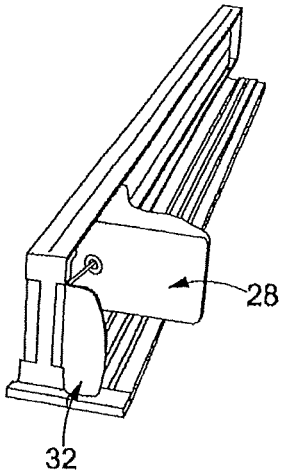

The underside of the front end fitting 16 is provided with recesses containing friction pads 52, conveniently in the form of an appropriate friction enhancing gel material. A further recess containing a magnet 54 is also provided. The underside of the rear end fitting 18 is provided with mounting features (not shown) cooperable with a mounting rail 58 secured to a rear part of the shelf. As shown in FIG. 7, the mounting rail 58 may be arranged to be adhered to the upper surface of the shelf. Alternatively, it may include a flange adapted to be received within a channel associated with the shelf, in use, to be secured in position as shown in FIG. 8. In either case, a side face 58*a* of the mounting rail 58 is preferably formed with serrations or teeth, cooperable with corresponding formations provided on one of the mounting features so that, once secured to the mounting rail 58, lateral movement of the guide member 12 relative to the mounting rail 58 is not permitted.

In use, in order to secure the device 10 in position, firstly the mounting rail 58 is secured to the shelf with which the device 10 is to be used, the mounting rail 58 being located at or adjacent a rear part of the shelf. As a result, the presence of the mounting rail 58 will be obscured by stock located upon the shelf and so it will have minimal visible impact. The guide member 12 is then secured to the mounting rail 58 by hooking the mounting formations onto the mounting rail 58 with the guide member 12 in the desired position on the shelf. Once attached to the mounting rail 58, the front end of the guide member 12 is lowered onto the surface of the shelf, magnetic attraction between the magnet 54 and the material of the shelf resisting lifting movement of the guide member 12, and the pads 52 resisting lateral movement of the front part of the guide member 12. It will be appreciated that once so positioned, movement of the guide member 12 is resisted, the guide member 12 being securely attached or mounted in position. However, when required, the guide member 12 may be repositioned by lifting the front end of the guide member 12 resulting in partial unhooking of the mounting features from the mounting rail 58. Once partially unhooked in this manner, the guide member 12 can be slid lengthwise of the mounting rail 58, the mounting features ensuring that the guide member 12 remains perpendicular to the mounting rail 58 during such movement. Once in the desired position, it can be re-secured in position as outlined above.

Once positioned as required, stock may be introduced by pushing the stock past the stop member 32, causing the stop member 32 to pivot to the stocking position, the stock bearing against the face of the pusher device 28 urging the pusher device 28 towards the rear end of the guide member 12. The movement of the pusher device 28 results in part of the cable 46 being withdrawn from the spool 36, the spool 36 rotating against the action of the associated spring. Once the stock has been introduced, the stop member 32 will return to the retaining position under the action of the associated spring 32*b*, and the spring located within the spool 36 will apply a load to the spool 36, urging the spool 36 for rotation taking up the cable 46 and applying a load to the pusher device 28 urging the pusher device 28 and stock engaged thereby towards the front edge of the shelf. Movement of the pusher device 28 and stock is limited by engagement of the stock with the stop member 32. It will be appreciated that, in this manner, the stock is neatly presented at the front edge of the shelf.

If a shopper withdraws a product from the shelf, the pusher device 28 will operate in substantially the manner outlined above to push the remaining stock towards the front edge of the shelf. The rate at which the stock is moved is controlled by the operation of the damper, thereby avoiding unduly rapid movement of the stock, and reducing the risk of damage thereto.

It will be appreciated that the use of the invention is advantageous in that stock carried by a shelf is maintained, as desired, towards the front of the shelf, enhancing the uniformity of the display. The manner in which the guide device 12 is secured in position avoids the need for a bulky step or rail at or adjacent the front of the shelf, and so the visible appeal of stock located upon the shelf is not significantly negatively impacted by the presence of the device 10. The pivotable stop members 32 allow stock to be introduced in a simple and convenient manner.

As stock is neatly presented to the front edge of the shelf, it may not be immediately apparent to restocking operatives when restocking is required. In order to obviate this, a microswitch or the like may be mounted to the guide in a position to be engaged by the pusher when the pusher reaches a position in which restocking or stock replenishment is desired, closing of the microswitch by the pusher causing an LED or other indicator to be operated so as to provide an indication that restocking or stock replenishment is desired. It will be appreciated that the subsequent restocking results in the pusher being moved to a position in which the microswitch is no longer engaged, and so the LED or the like is no longer operated.

Figure 13:
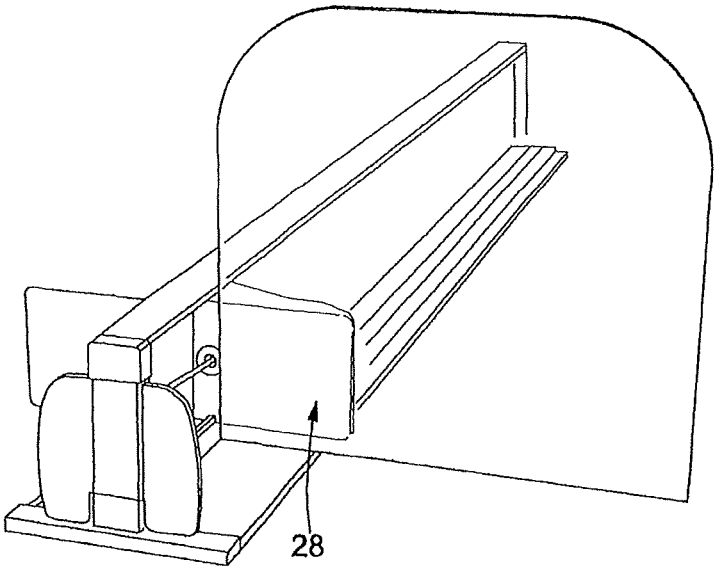

Whilst for the most part in the description above, reference is made only to a single stop member and pusher device, as shown in FIGS. 1 and 2 the guide member 12 may carry a pair of such stop members 32 and pusher devices 28. As shown in FIGS. 9 to 12, variants may be produced in which only a single pusher device 28 is provided, and/or in which only a single stop member 32 is provided. It is envisaged that, in most applications, stock will be located within a channel defined between a pair of the guide members 12, and stop members 32 associated with each of the guide members 12 will act, together, to limit the forward movement of stock. Depending upon the size and weight of the stock, a single pusher device 28 or a pair of pusher devices 28 may be used to move the stock along the channel. Where large or bulky, low weight products are located upon the shelf then rather than use a pair of pusher devices 28, it may be preferred to modify the pusher device 28, for example as shown in FIG. 13, to increase the area of the pusher member 28 engageable with the product.

Variants incorporating different springs may be provided, the spring selection being tailored to the product to be moved using the pusher device, to ensure that the pusher device 28 applies an appropriate pushing load to the stock. By way of example, versions including 6, 10 and 14N springs may be provided. It is also envisaged to provide an arrangement in which a plurality of springs are provided within a single spring housing, a mechanism being provided to determine which of the springs is/are active at any given time. The design of the damper may be such as to permit a good level of control over the magnitude of the applied damping load and hence over the rate of movement of the pusher device 28.

The device may be produced in a range of sizes, and so the invention may be suitable for use in adjusting the positions of, for example, small cosmetic products, drinks cans and bottles, and larger products. It will be appreciated that the invention is not restricted in this regard.

It will be understood that aspects of the invention may be employed with designs of shelf management system other than that described hereinbefore. By way of example, the stop members may be employed with a gravity fed shelf management system, rather than a spring biased one as described hereinbefore, if desired, without departing from the scope of the invention as defined by the appended claims.

It will be appreciated that whilst the description hereinbefore relates, primarily, to one specific example embodiment, a wide range of modifications and alterations may be made thereto without departing from the scope of the invention. By way of example, rather than damp movement by damping the rotation of the spool, a damping arrangement could be provided between the pusher member and the guide rail.

The invention claimed is:

1. A shelf management device comprising a guide member having a front end and a rear end, and a pusher device guided for movement by the guide member, wherein the pusher device comprises a rotatable spool upon which is wound a flexible drive member, an end part of the drive member being secured to the guide member at or adjacent the front end thereof, a spring separate from the drive member provided to urge the spool for rotation to wind the drive member onto the spool and thereby apply a load to the pusher device urging the pusher device towards the front end of the guide member, and a damping arrangement adapted to damp the rotation of the spool, damping the winding of the drive member onto the spool, and thereby damping the movement of the pusher device arising from the rotation of the spool under the action of the spring.

2. The device according to claim 1, wherein the drive member comprises a wire or cable.

3. The device according to claim 1, wherein the damping arrangement comprises a brake member biased against a surface of the spool.

4. The device according to claim 1, wherein the damping arrangement comprises a viscous fluid based rotary damping arrangement.

5. The device according to claim 1, wherein the damping arrangement comprises a damper member supporting the spool for rotation.

6. The device according to claim 1, wherein the damping arrangement damps rotation of the spool in one rotary direction, but the spool is free to move substantially without damping by the damping arrangement in the opposite rotary direction.

7. The device according to claim 1, wherein a damping load applied by the damping arrangement is controllable, to allow control over the rate of movement of the pusher device.

* * * * *